US011690453B2

(12) United States Patent
Zhang

(10) Patent No.: US 11,690,453 B2
(45) Date of Patent: Jul. 4, 2023

(54) MOVABLE CHAIR SUPPORT STRUCTURE AND CHAIR HAVING THE SAME

(71) Applicant: Xiaozhao Zhang, Chuzhou (CN)

(72) Inventor: Xiaozhao Zhang, Chuzhou (CN)

( * ) Notice: Subject to any disclaimer, the term of this patent is extended or adjusted under 35 U.S.C. 154(b) by 300 days.

(21) Appl. No.: 17/158,004

(22) Filed: Jan. 26, 2021

(65) Prior Publication Data

US 2022/0125200 A1 Apr. 28, 2022

(30) Foreign Application Priority Data

Oct. 22, 2020 (CN) ..... 202022393822.4

(51) Int. Cl.

| | |
|---|---|
| ***A47C 1/023*** | (2006.01) |
| ***A47C 1/034*** | (2006.01) |
| ***A47C 1/032*** | (2006.01) |
| ***A47C 1/028*** | (2006.01) |

(52) U.S. Cl.

CPC ..... *A47C 1/023* (2013.01); *A47C 1/028* (2013.01); *A47C 1/032* (2013.01); *A47C 1/0342* (2013.01)

(58) Field of Classification Search

CPC ..... A47C 1/023; A47C 1/028; A47C 1/032; A47C 1/0342

See application file for complete search history.

(56) References Cited

U.S. PATENT DOCUMENTS

2012/0049606 A1* 3/2012 Lawson ..... A47C 1/0342 74/521
2015/0208805 A1* 7/2015 Griggs, Jr. ..... A47C 1/03222 74/89
2015/0289655 A1* 10/2015 Lawson ..... 297/75
2016/0058195 A1* 3/2016 Huang ..... A47C 1/031 248/398
2018/0027968 A1* 2/2018 Lawson ..... A47C 1/0355

* cited by examiner

*Primary Examiner* — Anthony D Barfield

(57) ABSTRACT

The present disclosure provides a movable chair support structure including a movable mechanism, a fixing support structure and a chair support structure. The movable mechanism includes a transmission component and a movable component. The chair support structure includes a chair support portion, which has a length of 500 mm to 530 mm. When the movable chair support structure is disposed on the ground, the chair support portion is inclined relative to a direction parallel to the ground. The chair support portion is pivotally connected to the movable component. The movable component is pivotally connected to the fixing support structure. The transmission component is independently pivotally connected to the chair support portion and the movable component, respectively. The transmission component rotates relative to the chair support structure and drives the movable component to move, so as to adjust a position of the chair support structure relative to the fixing support structure.

16 Claims, 3 Drawing Sheets

MOVABLE CHAIR SUPPORT STRUCTURE AND CHAIR HAVING THE SAME

CROSS REFERENCE TO RELATED APPLICATIONS

This application claims all benefits accruing under 35 U.S.C. § 119 from China Patent Application No. 202022393822.4, filed on Oct. 22, 2020, titled "MOVABLE CHAIR SUPPORT STRUCTURE AND CHAIR HAVING THE SAME" in the China National Intellectual Property Administration, the content of which is hereby incorporated by reference.

TECHNICAL FIELD

The present disclosure relates to chairs, and in particular, to a movable chair support structure and a chair having the same.

BACKGROUND

At present, more and more seat products have adjustable sitting functions, so as to better meet the needs of special users such as the elderly and people with physical impairments. These seat products can have different sitting states, such as a normal sitting state, a casual state and a lying state.

Conventional seat products with adjustable sitting functions have a defect of insufficient seat depth, and cannot fully accommodate and support the body of the user. Therefore, the user may cannot experience the different sitting postures of the seat, and the user's comfort cannot be met.

SUMMARY

It is necessary to provide an improved movable chair support structure and a chair having the same.

The present disclosure provides a movable chair support structure including a movable mechanism, a fixing support structure and a chair support structure. The movable mechanism includes a transmission component and a movable component. The chair support structure includes a chair support portion, which has a length of 500 mm to 530 mm. When the movable chair support structure is sitting on the ground, the chair support portion is inclined relative to a direction parallel to the ground. The chair support portion is pivotally connected to the movable component. The movable component is pivotally connected to the fixing support structure. The transmission component is independently pivotally connected to the chair support portion and the movable component, respectively. The transmission component rotates relative to the chair support structure and drives the movable component to move, so as to adjust a position of the chair support structure relative to the fixing support structure.

Furthermore, an angle between the chair support portion and the direction parallel to the ground is in a range of 5 degrees to 15 degrees.

Therefore, the angle of the chair support portion can change, so that the chair having the chair support portion can fully support the body, have good comfort, and facilitate a user to relax.

The chair support structure further includes a backrest support portion disposed on an end of the chair support portion. The backrest support portion is fixed to the chair support portion and an angle of the chair defined by the backrest support portion and the chair support portion is in a range of 100 degrees to 115 degrees.

Therefore, the backrest support portion can support the waist of the user, and the chair at a certain angle can fully support and accommodate the haunch of a user.

Furthermore, the chair support portion includes a first pivot point and a second pivot point, which are independently pivotally connected to the movable component. A distance between the first pivot point and the second pivot point is in a range of 310 mm to 340 mm.

Therefore, the distance between the first pivot point and the second pivot point can be larger, and the altitude change of the chair support structure relative to the fixing support structure caused by movement of the movable component can be decreased, so that an altitudinal position and a supporting height of the chair can be relatively stable.

Furthermore, the chair support portion includes a third pivot point pivotally connected to the transmission component. The third pivot point is located between the first pivot point and the second pivot point, and a distance between the first pivot point and the third pivot point is in a range of 110 mm to 140 mm.

Therefore, the distance between the third pivot point and the first pivot point can be enough for the transmission component to move, so as to prevent interference between the transmission component and the movable component.

Furthermore, the transmission component includes a rotating arm and a first transmission rod. The rotating arm is pivotally connected to the chair support portion and a first end of the first transmission rod, respectively. A second end of the first transmission rod opposite to the first end of the first transmission rod is pivotally connected to the movable component. The rotating arm is capable of rotating relative to the chair support structure, and drives the movable component to move via the first transmission rod.

Furthermore, the movable component includes a first connecting rod, a second connecting rod, a third connecting rod, a fourth connecting rod and a fifth connecting rod. Two ends of the first connecting rod are pivotally connected to the fixing support structure and the second connecting rod, respectively. Two ends of the fifth connecting rod are pivotally connected to the fixing support structure and the fourth connecting rod, respectively. Two ends of the third connecting rod are pivotally connected to the second connecting rod and the fourth connecting rod, respectively. The chair support portion is pivotally connected to the second connecting rod and the fourth connecting rod, respectively. The chair support portion, the second connecting rod, the third connecting rod and the fourth connecting rod define a first four-rod mechanism. The first four-rod mechanism is capable of expanding or contracting to drive the chair support structure to move relative to the fixing support structure.

Therefore, the movable component can expand or contract relative to the fixing support structure, so as to change a longitudinal position of the chair support structure relative to the fixing support structure while switching the sitting states of the chair. The chair can adapt to different gravity centers of the user and different pressure distributions on the chair support structure when the chair is in different sitting states.

Furthermore, the movable chair support structure includes two sets of the chair support structure and two sets of the movable mechanism. The two sets of the chair support structure and two sets of the movable mechanism are symmetrically disposed, respectively, and capable of moving synchronously.

Therefore, two sets of the chair support structure and two sets of the movable mechanism can fully support the user, so that the movement of the movable chair support structure can be more coordinated, and the user will feel safer.

Furthermore, the movable chair support structure further includes a footrest, which is pivotally connected to the chair support portion, and further pivotally connected to the transmission component. The transmission component is capable of driving the footrest to expand or contract relative to the chair support structure.

Therefore, the footrest mechanism of the chair can be changed in different sitting states, so as to support the legs and feet of the user, and improve comfort of using.

The present disclosure further provides a chair including the movable chair support structure.

The present disclosure provides a movable chair support structure and a chair having the same. The chair has an enlarged support area on the basis of congeneric products. Therefore, the chair in the present disclosure can bear more weight of the user. Especially when the chair is in the casual state or the lying state and the body of the user is inclined, the user will feel safer. Furthermore, the chair having the movable chair support structure has a deeper depth, and can fully accommodate the user, so that the user will feel more comfortable. In addition, a chair support portion having a relatively large size can decrease the altitude change of the chair support structure relative to the fixing support structure caused by movement of the movable component. Therefore, when the chair is in different sitting states, different gravity centers of a user and different pressure distributions on the chair support structure are relatively stable, so as to avoid unreliability of the user caused by large height changes.

In the present disclosure, 111 represents a rotating arm; 112 represents a first transmission rod; 113 represents a second transmission rod; 114 represents a third transmission rod; 115 represents a fourth transmission rod; 121 represents a first connecting rod; 122 represents a second connecting rod; 123 represents a third connecting rod; 124 represents a fourth connecting rod; 125 represents a fifth connecting rod; 20 represents a fixing support structure; 21 represents a beam; 22 represents a carling; 23 represents a slide rail; 30 represents a chair support structure; 31 represents a chair support portion; 311 represents a first pivot point; 312 represents a second pivot point; 313 represents a third pivot point; 32 represents a backrest support portion; 41 represents a first backrest element; 42 represents a second backrest element; 50 represents a footrest; 200 represents a chair; 211 represents a driving component; 212 represents a displacement component; 213 represents a folding component; 214 represents a torsion resistance rod; 215 represents a crank.

DETAILED DESCRIPTION

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the present disclosure.

All technical and scientific terms used herein have the same meaning as commonly understood by one of ordinary skill in the art to which this disclosure is claimed. The terminology used in the description herein is for the purpose of describing particular embodiments, and is not intended to limit the disclosure. The term "or/and" as used herein includes any and all combinations of one or more of the associated listed items.

The present disclosure provides a movable chair support structure and a chair having the same. The movable chair support structure defines a supporting and moving framework of a chair, which has three different sitting states including a normal sitting state, a casual state and a lying state.

Figure 1:
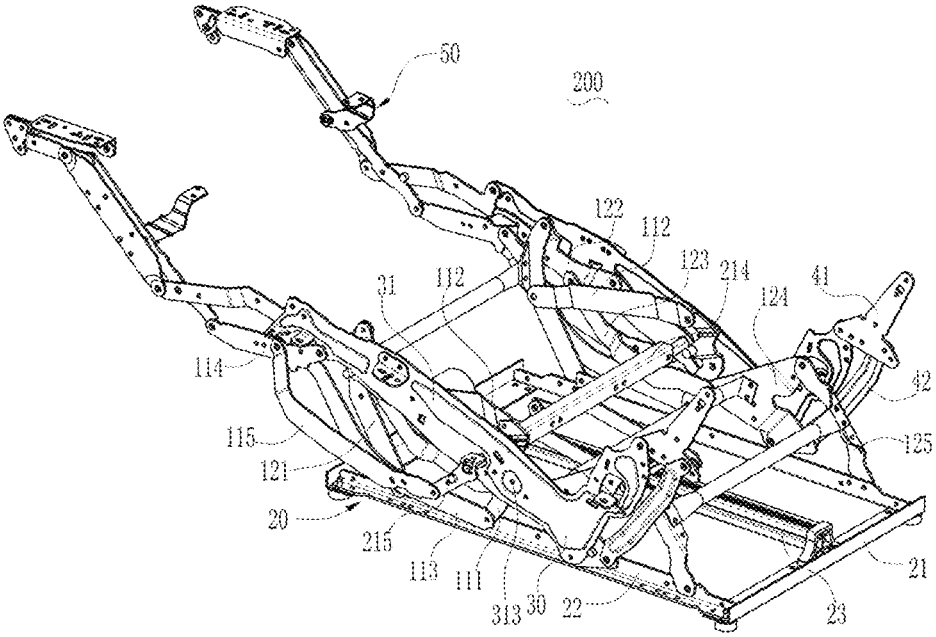
FIG. 1 is a structural schematic view of a chair in one embodiment of the present disclosure.
Figure 2:
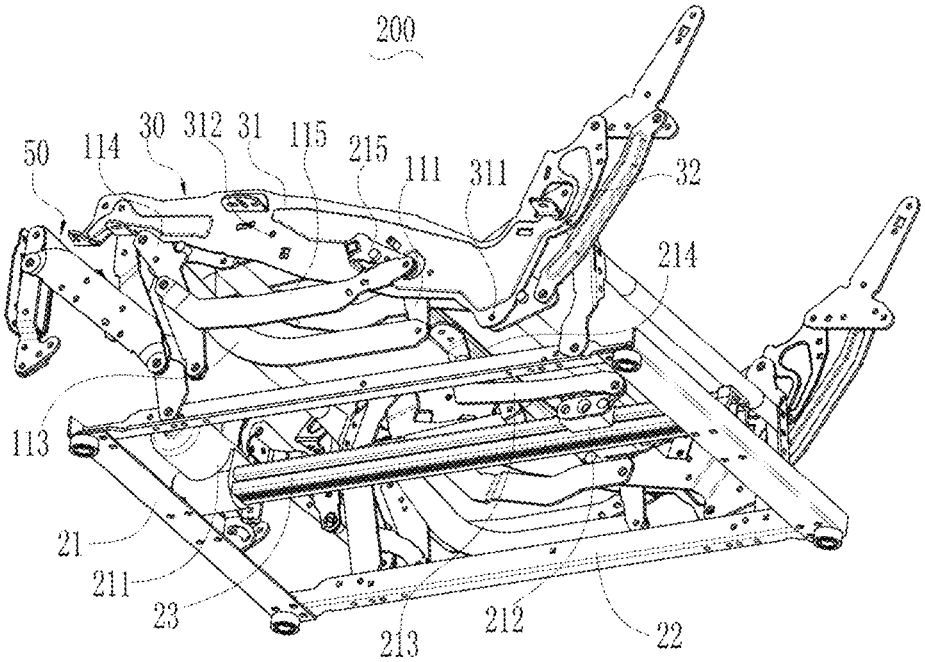
FIG. 2 is a schematic view of the chair of FIG. 1 in a normal sitting state with a first angle.
Figure 3:
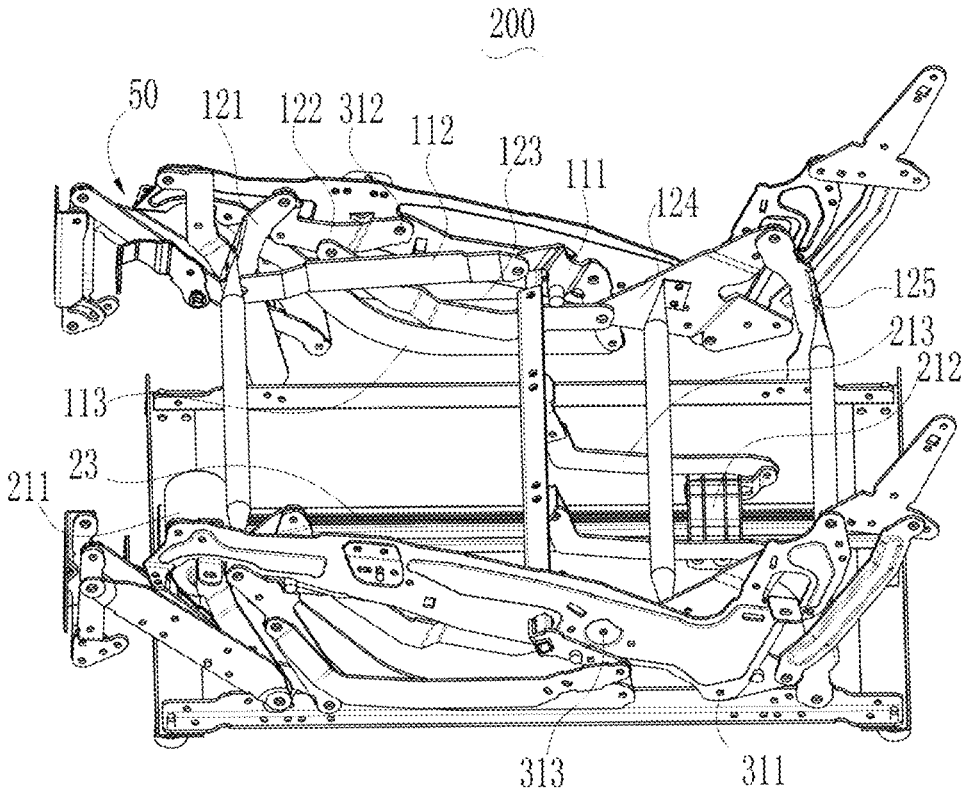
FIG. 3 is a schematic view of the chair of FIG. 1 in a normal sitting state with a second view angle.
Figure 4:
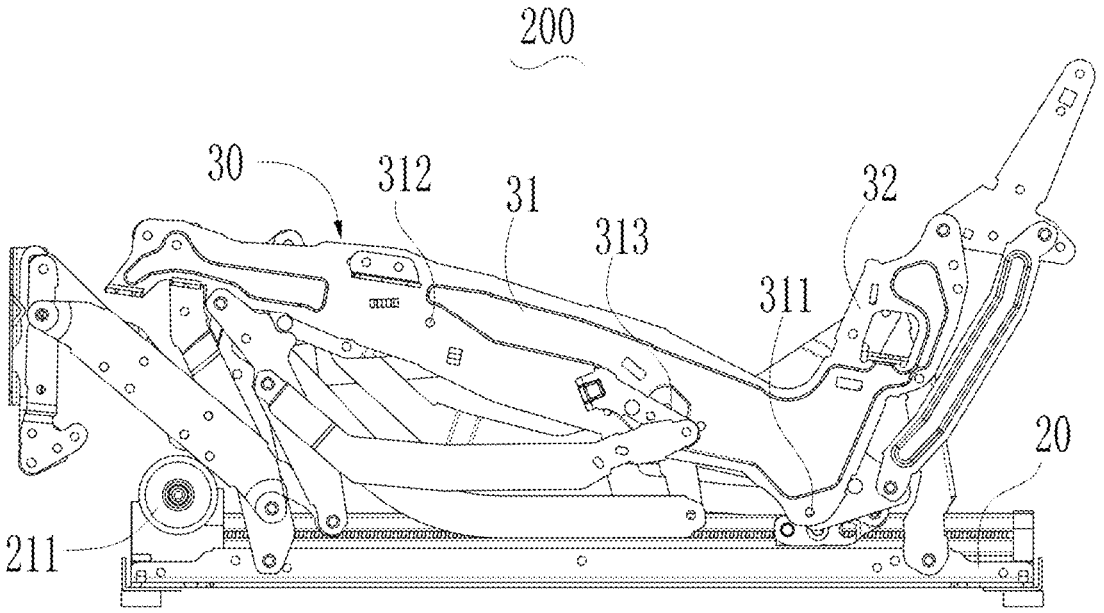
FIG. 4 is a front view of the chair of FIG. 1 in a normal sitting state.
Figure 5:
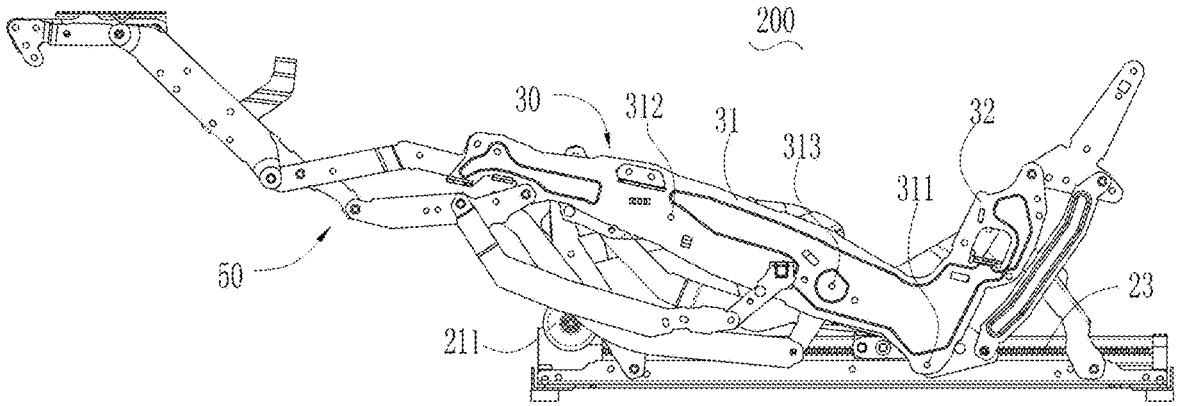
FIG. 5 is a front view of the chair of FIG. 1 in a casual state.
Figure 6:
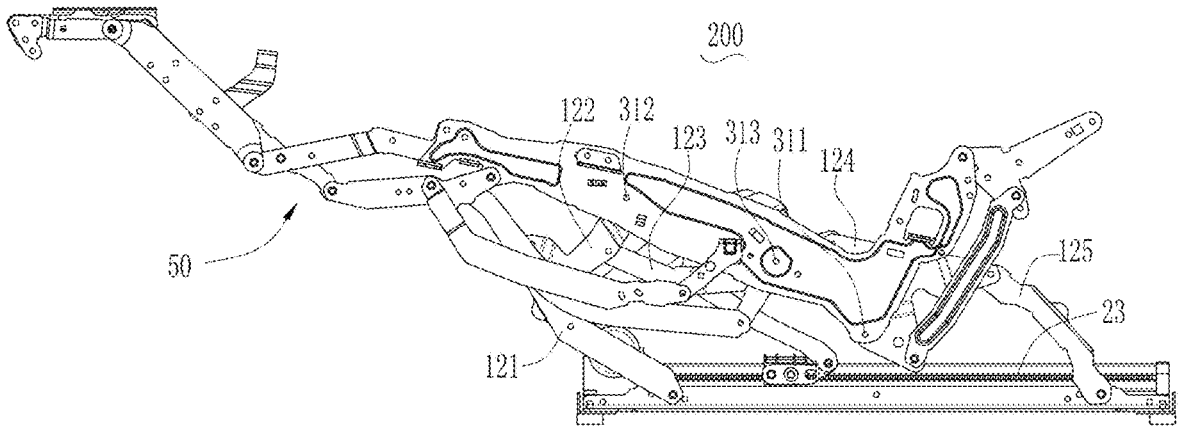
FIG. 6 is a front view of the chair of FIG. 1 in a lying state.

Referring to FIG. 1 to FIG. 6, FIG. 1 is a structural schematic view of a chair 200 in one embodiment of the present disclosure. FIG. 2 is a schematic view of the chair 200 of FIG. 1 in a normal sitting state with a first angle. FIG. 3 is a schematic view of the chair 200 of FIG. 1 in a normal sitting state with a second view angle. FIG. 4. is a front view of the chair 200 of FIG. 1 in a normal sitting state. FIG. 5 is a front view of the chair 200 of FIG. 1 in a casual state. FIG. 6 is a front view of the chair 200 of FIG. 1 in a lying state.

In an embodiment of the present disclosure, the sitting state of the movable chair support structure can be changed by an electrical driving mechanism disposed in the chair 200. The movable chair support structure can be driven by and connected to the driving mechanism. It could be understood that in other embodiments, the sitting states of the movable chair support structure can be manually changed by the user. Therefore, the energy source of the movable chair support structure in the present disclosure is not specifically limited.

For convenience, the chair 200 having an electrical driving mechanism will be described in detail hereinafter as an embodiment (which is named the present embodiment for short). And a manually-driven method of the movable chair support structure will not be described in detail.

Conventional chairs having adjustable sitting states have a defect of insufficient depth, which cannot fully accommodate and support the body of the user. Therefore, the user will not feel safe when adjusting the sitting states of the chair 200, and the comfort requirement of the user cannot be met.

The chair 200 in the present disclosure can include a driving mechanism and a movable chair support structure. The movable chair support structure can include a movable mechanism, a fixing support structure 20, a chair support structure 30 and a footrest 50. The fixing support structure 20 can be an installing base of the movable mechanism and the chair support structure 30. In order to ensure the chair 200 being disposed on the ground stably, the fixing support structure 20 in the present embodiment can be preferably a rectangle framework, which includes two parallel beams 21 and two parallel carlings 22. The beam 21 can be configured for fixing and installing the driving mechanism and the carling 22 can be configured for connecting the movable mechanisms. A slide rail 23 can be disposed between the two beams 21, and the concrete purpose of which will be described in detail hereinafter.

The movable mechanism can include a transmission component and a movable component. The transmission component can be configured for transmitting the power provided by the driving component 211 to the movable component, and driving the movable component to move. The movable component can be driven to fold or retract relative to the fixing support structure 20, and can drive the chair support structure 30 to move relative to the fixing support structure 20, so as to change sitting states of the chair between a normal sitting state, a casual state and a lying state.

Specifically, the transmission component can include a rotating arm 111, a first transmission rod 112, a second transmission rod 113, a third transmission rod 114 and a fourth transmission rod 115. The rotating arm 111 can be pivotally connected to the chair support structure 30, and two ends of the rotating arm 111 can be pivotally connected to the first transmission rod 112 and the second transmission rod 113, respectively. An end of the first transmission rod 112 away from the rotating arm 111 can be pivotally connected to the movable component. An end of the second transmission rod 113 away from the rotating arm 111 can be pivotally connected to the third transmission rod 114. An end of the fourth transmission rod 115 can be pivotally connected to the third transmission rod 114, and the other end of the fourth transmission rod 115 can be driving connected to the driving mechanism. A connection between the transmission component and the driving mechanism will be illustrated hereinafter.

The movable component can include a first connecting rod 121, a second connecting rod 122, a third connecting rod 123, a fourth connecting rod 124 and a fifth connecting rod 125. Two ends of the first connecting rod 121 can be pivotally connected to the carling 22 of the fixing support structure and the second connecting rod 122, respectively. The first connecting rod 121 can be pivotally connected to the first transmission rod 112. Two ends of the fifth connecting rod 125 can be pivotally connected to the carling 22 of the fixing support structure 20 and the fourth connecting rod 124, respectively. Two ends of the third connecting rod 123 can be pivotally connected to the second connecting rod 122 and the fourth connecting rod 124, respectively. The second connecting rod 122 and the fourth connecting rod 124 can be further pivotally connected to the chair support structure 30. The chair support structure 30, the second connecting rod 122, the third connecting rod 123 and the fourth connecting rod 124 can define a first four-rod mechanism. The first transmission rod 112 can be driven by the driving mechanism to drive the first connecting rod 121 to rotate relative to the carling 22 of the fixing support structure 20, thereby driving the entire movable component to expand or contract relative to the fixing support structure 20, further driving the first four-rod mechanism to expand or contract, and finally driving the chair support structure 30 to move relative to the fixing support structure 20, so as to change three different sitting states of the chair.

The footrest 50 can be pivotally connected to one end of the chair support structure 30, and can be connected to the driving mechanism via the transmission component. Specifically, in the present embodiment, the footrest 50 can be a foldable mechanism form by multiple pivotally connected connecting rods, and can further include an element pivotally connected to the third transmission rod 114. The transmission component can be driven by the driving mechanism to drive the footrest 50 to expand or contract relative to the chair support structure 30 via the third transmission rod 114. That is, in the present embodiment, the transmission component can further play a role of transmitting the energy to the footrest 50. When the movable chair support structure is in the normal sitting state, the footrest 50 can be folded and located near the chair support structure 30. When the movable chair support structure is adjusted to be in the casual state or the lying state by the driving mechanism, the footrest 50 can be expanded and can protrude along a direction away from the chair support structure 30, thereby facilitating to provide stretching space and support for the legs of the user.

The support structure 30 can be configured for bearing weight of the user and include a chair support portion 31 for supporting the legs and the haunch of the user. The chair support portion 31 can respectively include a first pivot point 311 and a second pivot point 312. The chair support portion 31 can be pivotally connected to the fourth connecting rod 124 via the first pivot point 311, and pivotally connected to the second connecting rod 122 via the second pivot point 312. The chair support portion 31 can be further provided with a third pivot point 313 for pivotally connecting to the transmission component, and a fourth pivot point 314 for pivotally connecting to the footrest 50. When the movable chair support structure is disposed on the ground, the chair support portion 31 can be inclined relative to a direction parallel to the ground. In the present embodiment, the chair support port 31 can have a length in a range of 500 mm to 530 mm Comparing with congeneric products, the length of the chair support portion 31 can be obviously increased by extending the distance between the first pivot point 311 and the second pivot point 312. Furthermore, an angle between the chair support portion 31 and the direction parallel to the ground is in a range of 5 degrees to 15 degrees.

Specifically, in the present embodiment, the chair support structure 30 can further include a backrest support portion 32 disposed at one end of the chair support portion 31. The backrest support portion 321 can be configured for connecting the backrest component, and supporting the waist of the user. The backrest support portion 32 can be fixed to the chair support portion 31. An angle of the chair defined by the backrest support portion 32 and the chair support portion 31 is in a range of 100 degrees to 115 degrees, which matches with an angle between the haunch and the waist of the body when the user is sitting or lying. In addition, the chair can better accommodate the haunch of the user and support the user, so as to improve the user's comfort.

The first pivot point 311 can be disposed at the end of the chair support portion 31 near the backrest support portion 32, i.e., the end of the chair support portion 31 near the back of the user. The second pivot point 312 can be disposed at the end of the chair support portion 31 away from the backrest support portion 32, i.e., the side of the chair support portion 31 near the feet of the user. The third pivot point 313 can be disposed between the first pivot point 311 and the second pivot point 312. The fourth pivot point can be disposed on an end of the chair support portion 31 away from the end provided with the first pivot point 311. The second pivot point 31 can be located between the first pivot point 311 and the fourth pivot point. A distance between the first pivot point 311 and the second pivot point 312 can be in a range of 310 mm to 340 mm, and a distance between the first pivot point 311 and the third pivot point 313 can be in a range of 110 mm to 140 mm.

Therefore, the chair support portion 31 of the chair support structure 30 has a larger size, so that the support area of the chair 200 can be increased, and the user will feel safer. The increased chair support portion 31 and the angle defined by the chair support portion 31 and the ground can better accommodate the body of the user, thereby increasing the depth of the chair 200 and obviously increasing user comfort. Furthermore, the larger size of the chair support structure and the long distance between the first pivot point 311 and the second pivot point 312 can decrease the altitude change of the chair support structure 30 relative to the fixing support structure 20 caused by movement of the movable component, so that a height of the chair 200 can be relatively stable, and the user will feel safer while changing the sitting state of the chair 200.

Furthermore, in the present disclosure, the movable chair support structure can further include a movable backrest component, which can include a first backrest element 41 and a second backrest element 42. The first backrest element 41 can be pivotally connected to the backrest support portion 32, and configured for supporting the neck and the shoulder of the user. The second backrest element 42 can be pivotally connected to the fourth connecting rod 124, and pivotally connected to the first backrest element 41. The first backrest element 41, the second backrest element 42, the fourth connecting rod 124 and the chair support structure 30 can define a quadrilateral mechanism. When the movable chair support structure is driven by the driving component 211, the chair support structure 30 and the movable component can move relative to the fixing support structure 20, while driving the quadrilateral mechanism to expand and contract along the defined path, so as to change an angle between the first backrest element 41 and the backrest support portion 32. When the movable chair support structure is in normal sitting state, the first backrest element 41 can be approximately parallel to the backrest support portion 32. When the movable chair support structure is in the casual state or the lying state, the first backrest element 41 can rotate relative to the backrest support portion 32 in the direction towards the fixing support structure 20.

Therefore, the backrest component can move while the chair support structure 30 and the movable component moving relative to the fixing support structure 20, so that the backrest component can adapt to different sitting states and can adjustably support the shoulder and the neck of the user, thereby further improving comfort of the user.

The chair 200, the driving mechanism and the principles thereof in the present disclosure will be described in detail hereinafter.

In the present embodiment, the driving mechanism can include a driving component 211, a displacement component 212 and a folding component 213. The driving component 211 can be preferably an electrical motor. The displacement component 212 can be disposed on the fixing support structure 20, and two ends of the displacement component 212 can be connected to the beam 212 and the slide rail 23, and the displacement component 212 can be slidable. The displacement component 21 can be driven by the electrical motor and can slide along the direction the slide rail 23 protrudes, and the sliding path of which can be parallel to the carling 22 of the fixing support structure 20. The folding component 213 can be formed by a movable mechanism including multiple pivotally connected connecting rods, and pivotally connected to the displacement component 212 and connected to the transmission component. The movable chair support structure can include two sets of the chair support structure 30, two sets of the footrest 50 and two sets of the movable mechanism. The two sets of the chair support structure 30, two sets of the footrest 50 and two sets of the movable mechanism can be symmetrically disposed, respectively, and capable of moving synchronously.

Specifically, at least one linking rod can be disposed between the two sets of the movable component. In the present embodiment, two linking rods can be disposed between the two sets of the movable component. The two linking rods can be connected to the first connecting rod 121 and the fifth connecting rod 125 in the two sets of the movable component, respectively. A torsion resistance component can be disposed between two sets of chair support structure 30. The torsion resistance component can include a torsion resistance rod 214 pivotally connected to the chair support structure 30, and two cranks 215 fixed to two ends of the torsion resistance rod 214. The torsion resistance rod 214 can be connected to the folding component 213, and the middle portion of the torsion resistance rod 214 can be a hollow pipe having a square cross section. The two cranks 215 can be pivotally connected to the fourth transmission rod 115 in the two sets of the transmission component, respectively.

The folding component 213 can include a folding unit, a first fixing unit and a second fixing unit. Two ends of the folding units can be pivotally connected to the first fixing unit and the second fixing unit, respectively. The first fixing unit can be fixed to the displacement component 212, and the second fixing unit can be fixed to the torsion resistance rod 214. The displacement component 212 can be driven by the driving component 211 and can move along the slide rail 23, so as to drive the folding component 213 to move. The folding component 213 can drive the torsion resistance component to move, so as to transfer the energy to the movable mechanism and the foot rest 50 via the fourth transmission rod 115.

In a chair 200 having an electrical displacement component 212, the slide rail 23 can be provided with a conveyor belt component including a conveyor belt and a belt pulley; or the slide rail 23 can be provided with a chain transmission component including a chain and a chain pulley. The belt pulley or the chain pulley can be driven by a motor to drive the belt or the chain. The belt can be fixed to the displacement component 212 or meshed with the displacement component 212. The displacement component 212 can be driven by the conveyor belt component or the chain transmission component and can longitudinally reciprocate along the fixing support structure 20.

The present disclosure provides a movable chair support structure and a chair 200 having the same. The chair 200 has an improved support area on the basis of congeneric products. Therefore, the chair 200 in the present disclosure can bear more weight of the user. Especially when the chair is in a casual state or a lying state and the body of the user is inclined, the user will feel safer. Furthermore, the chair 200 having the movable chair support structure has a deeper depth, and can fully accommodate the user, so that the user will feel more comfortable. In addition, a chair support portion 31 having a relatively large size can decrease the altitude change of the chair support structure 30 relative to the fixing support structure 20 caused by movement of the movable component. Therefore, when the chair 200 is in different sitting states, different gravity centers of an user and different pressure distributions on the chair support structure 30 are relatively stable, so as to avoid unreliability of the user caused by large height changes.

The technical features of the above-described embodiments may be in any combination. For the sake of brevity of description, all possible combinations of the technical features in the above embodiments are not described. However, as long as there is no contradiction between the combinations of these technical features, all of the combinations should be considered as within the scope of this disclosure.

Although the devices have been described and illustrated using certain embodiments, however, the disclosure is not limited by the precise details set forth above. Many variations and modifications will be evident to those skilled in the art and may be made without departing from the spirit and scope of the disclosure.

What is claimed is:

1. A movable chair support structure comprising a movable mechanism, a fixing support structure and a chair support structure, wherein the movable mechanism comprises a transmission component and a movable component;

the transmission component comprises a rotating arm, a first transmission rod, a second transmission rod, a third transmission rod and a fourth transmission rod, and the movable component comprises a first connecting rod, a second connecting rod, a third connecting rod, a fourth connecting rod and a fifth connecting rod;

the chair support structure comprises a chair support portion, which has a length of 500 mm to 530 mm, and when the movable chair support structure is disposed on the ground, the chair support portion is inclined relative to a direction parallel to the ground; and the chair support portion is pivotally connected to the movable component, the movable component is pivotally connected to the fixing support structure, and the transmission component is pivotally connected to the chair support portion and the movable component, respectively; and the transmission component is capable of rotating relative to the chair support structure and driving the movable component to move, so as to adjust a position of the chair support structure relative to the fixing support structure, and, the rotating arm is pivotally connected to the chair support structure, and two ends of the rotating arm are pivotally connected to the first transmission rod and the second transmission rod, respectively; an end of the first transmission rod away from the rotating arm is pivotally connected to the movable component; an end of the second transmission rod away from the rotating arm is pivotally connected to the third transmission rod; an end of the fourth transmission rod is pivotally connected to the third transmission rod, and the other end of the fourth transmission rod is driving connected to a driving mechanism;

two ends of the first connecting rod are pivotally connected to the fixing support structure and the second connecting rod, respectively; the first connecting rod is pivotally connected to the first transmission rod; two ends of the fifth connecting rod are pivotally connected to the fixing support structure and the fourth connecting rod, respectively; two ends of the third connecting rod are pivotally connected to the second connecting rod and the fourth connecting rod, respectively; the chair support portion is pivotally connected to the second connecting rod and the fourth connecting rod, respectively; the chair support portion, the second connecting rod, the third connecting rod and the fourth connecting rod define a first four-rod mechanism; and the first four-rod mechanism is capable of expanding or contracting to drive the chair support structure to move relative to the fixing support structure.

2. The movable chair support structure of claim 1, wherein an angle between the chair support portion and the direction parallel to the ground is in a range of 5 degrees to 15 degrees.

3. The movable chair support structure of claim 1, wherein the chair support structure further comprises a backrest support portion disposed on an end of the chair support portion, the backrest support portion is fixed to the chair support portion and an angle of the chair defined by the backrest support portion and the chair support portion is in a range of 100 degrees to 115 degrees.

4. The movable chair support structure of claim 1, wherein the chair support portion comprises a first pivot point and a second pivot point, which are independently pivotally connected to the movable component; and a distance between the first pivot point and the second pivot point is in a range of 310 mm to 340 mm.

5. The movable chair support structure of claim 4, wherein the chair support portion further comprises a third pivot point pivotally connected to the transmission component; the third pivot point is located between the first pivot point and the second pivot point, and a distance between the first pivot point and the third pivot point is in a range of 110 mm to 140 mm.

6. The movable chair support structure of claim 1, wherein the rotating arm is pivotally connected to the chair support portion and a first end of the first transmission rod, respectively, and a second end of the first transmission rod opposite to the first end of the first transmission rod is pivotally connected to the movable component; and, the rotating arm is capable of rotating relative to the chair support structure, and drives the movable component to move via the first transmission rod.

7. The movable chair support structure of claim 1, wherein the movable chair support structure comprises two sets of the chair support structure and two sets of the movable mechanism; and, the two sets of the chair support structure and two sets of the movable mechanism are symmetrically disposed, respectively, and capable of moving synchronously.

8. The movable chair support structure of claim 1, wherein the movable chair support structure further comprises a footrest, which is pivotally connected to the chair support portion, and further pivotally connected to the transmission component; and the transmission component is capable of driving the footrest to expand or contract relative to the chair support structure.

9. A chair, comprising the movable chair support structure of claim 1.

10. The chair of claim 9, wherein an angle between the chair support portion and the direction parallel to the ground is in a range of 5 degrees to 15 degrees.

11. The chair of claim 9, wherein the chair support structure further comprises a backrest support portion disposed on an end of the chair support portion, the backrest support portion is fixed to the chair support portion and an angle of the chair defined by the backrest support portion and the chair support portion is in a range of 100 degrees to 115 degrees.

12. The chair of claim 9, wherein the chair support portion comprises a first pivot point and a second pivot point, which are independently pivotally connected to the movable component; and a distance between the first pivot point and the second pivot point is in a range of 310 mm to 340 mm.

13. The chair of claim 12, wherein the chair support portion further comprises a third pivot point pivotally connected to the transmission component; the third pivot point is located between the first pivot point and the second pivot point, and a distance between the first pivot point and the third pivot point is in a range of 110 mm to 140 mm.

14. The chair of claim 9, wherein the rotating arm is pivotally connected to the chair support portion and a first end of the first transmission rod, respectively, and a second end of the first transmission rod opposite to the first end of the first transmission rod is pivotally connected to the movable component; and, the rotating arm is capable of rotating relative to the chair support structure, and drives the movable component to move via the first transmission rod.

15. The chair of claim 1, wherein the movable chair support structure comprises two sets of the chair support structure and two sets of the movable mechanism; and, the two sets of the chair support structure and two sets of the movable mechanism are symmetrically disposed, respectively, and capable of moving synchronously.

16. The chair of claim 1, wherein the movable chair support structure further comprises a footrest, which is pivotally connected to the chair support portion, and further pivotally connected to the transmission component; and the transmission component is capable of driving the footrest to expand or contract relative to the chair support structure.

* * * * *